United States Patent [19]

Broadhead

[11] Patent Number: 4,492,407

[45] Date of Patent: Jan. 8, 1985

[54] PATIENT SUPPORT AND TRANSVERSE MOTION LINKAGE THEREFOR

[75] Inventor: James H. Broadhead, Bay Minette, Ala.

[73] Assignee: Syntex (U.S.A.) Inc., Palo Alto, Calif.

[21] Appl. No.: 399,561

[22] Filed: Jul. 19, 1982

[51] Int. Cl.[3] ..... A47C 1/035

[52] U.S. Cl. ..... 297/78; 297/68; 297/84; 297/322

[58] Field of Search ..... 297/78, 79, 68, 83, 297/317, 71, 84, 85, 320, 321, 322

[56] References Cited

U.S. PATENT DOCUMENTS

| | | | |
|---|---|---|---|
| 477,906 | 6/1892 | Lockstaedt | 297/79 |
| 3,086,815 | 4/1963 | Fletcher | 297/85 |
| 3,089,741 | 5/1963 | Burton | 297/78 |
| 3,536,355 | 10/1970 | Osbeck | 297/78 |
| 3,719,391 | 3/1973 | Neri | 297/71 |
| 3,804,460 | 4/1974 | Leffler | 297/71 |

FOREIGN PATENT DOCUMENTS

| | | | |
|---|---|---|---|
| 540806 | 5/1957 | Canada | 297/84 |
| 2459109 | 6/1976 | Fed. Rep. of Germany | 297/322 |
| 1247421 | 10/1960 | France | 297/83 |

*Primary Examiner*—William E. Lyddane
*Assistant Examiner*—Mark W. Binder
*Attorney, Agent, or Firm*—David A. Lowin; John A. Dhuey

[57] ABSTRACT

A transverse motion linkage for a patient support has a four-bar linkage connecting the seat of the support and the base for forward transverse motion upon simultaneous reclining of the backrest and lifting of the leg rest through action of a three-bar, motion-imparting linkage.

17 Claims, 12 Drawing Figures

20
22
24
26
28
30
32
34
36
A
B 40
42
44
46
48
50
52
54
56
58
60
62
64
66
68
70
72
74
76
78
80
82
84
86
88
90
91
92
93
94
96
100
102
A
B

PATIENT SUPPORT AND TRANSVERSE MOTION LINKAGE THEREFOR

BACKGROUND OF THE INVENTION

The present invention relates to patient supports, more particularly to a reclining, chair-type patient support that automatically moves away from a wall as the backrest reclines. Specifically, the invention relates to a transverse motion linkage for a dental patient chair.

Patient supports of the type contemplated by this invention have a seat member with a backrest attached at one end and a legrest attached at the other end. The entire patient support can be raised and lowered, for allowing the patient to enter and exit, and for positioning the patient in order to be worked on.

Efficient use of office space is always an important consideration when planning the layout of a doctor's office, such as a dental operatory. One of the most space consumming pieces of equipment in the office is the patient support. Space must be allowed for the fully extended dimensions of the patient support, as well as for work space surrounding it.

A problem with reclining-back patient supports prior to the present invention was that additional room had to be left behind them, in order to accommodate for arcuate movement of the upper end of the backrest as it swings down toward a horizontal position. Furthermore, that swinging movement gave patients an unpleasant sensation of falling as the backrest dropped toward the floor.

Another problem that has remained unsolved until the present invention was that complex mechanisms were required for coordinating the lifting of a legrest with the reclining of a backrest, especially when providing for "close to the wall" positioning. A parallel bar linkage system has been used for imparting transverse, away-from-the-wall movement to a reclining chair. Reclining the backrest and simultaneously lifting the legrest was accomplished by manually pushing against stationary armrests from a seated position. The linkage systems used for this have been quite complicated, and would not be usefull for a patient support because they were designed to operate by manual movement rather than by motorized movement, and usually provided only two, pre-set positions. The full range of adjustability required for a patient support was not attainable.

OBJECTS OF THE INVENTION

Accordingly, it is an object of the invention to provide a simplified transverse motion linkage for a patient support.

Another object of the invention is to provide a linkage system for a patient support wherein reclining of the backrest simultaneously causes lifting of the legrest and transverse motion of the entire patient support in a forward direction.

Still another object of the invention is to provide a transverse motion linkage for a patient support that can be modified to have a sit-up type entry position or a lounge type entry position, without using new or additional parts.

Another object of the invention is to provide a patient support wherein the ratio of the horizontal distance between the top end of the backrest and the back end of the base in the fully reclined position, compared to the horizontal distance in the fully upright position, is about 1.5 to 1.

A still further object of the invention is to provide a patient support that gives a sensation of comfortable support throughout its entire range of travel.

SUMMARY OF THE INVENTION

The transverse motion linkage of the present invention has application for a patient support having a base, a seat, a pivotable backrest connected to the back side of the seat, and a pivotable legrest connected to the front side of the seat, and includes: a first, vertical link, pivotably connected between the base and a front portion of the seat; a second, vertical link, pivotably connected between the base and a midportion of the backrest, and a third, horizontal link, pivotably connected between the first and second vertical links at points near each of their midsections, these three elements forming a "4-bar" linkage when taken together with the base. The invention also includes a three-bar, motion-imparting linkage having a fourth, horizontal, arm-supporting link piviotably connected to the backrest at a point near its connection to the second vertical link. A fifth, vertical link is pivotably connected at its top end to the fourth, horizontal link near its free end. The fifth link is also pivotably connected to a side of the seat at a point near the pivotal connection of the first link to the seat. The fifth link extends downwardly at an angle, beyond the level of the seat. A sixth link is pivotably connected between the free, bottom end of the fifth link and is also pivotably connected to the leg support at a point forward of its pivotal connection to the seat. The fourth, fifth, and sixth links may be duplicated on each side of the seat to form a parallel pair of arm supports.

The transverse motion linkage of the invention simultaneously causes the legrest to lift as the backrest reclines, also shifting the entire patient support forward so that the backrest does not take up too much space behind the chair as it reclines.

Other objects, advantages and features of the present invention will become apparent from the following detailed discription of embodiments presented in conjunction with the accompanying drawing.

DETAILED DESCRIPTION OF THE PREFERRED EMBODIEMENTS

Figures 1, 2, 3:
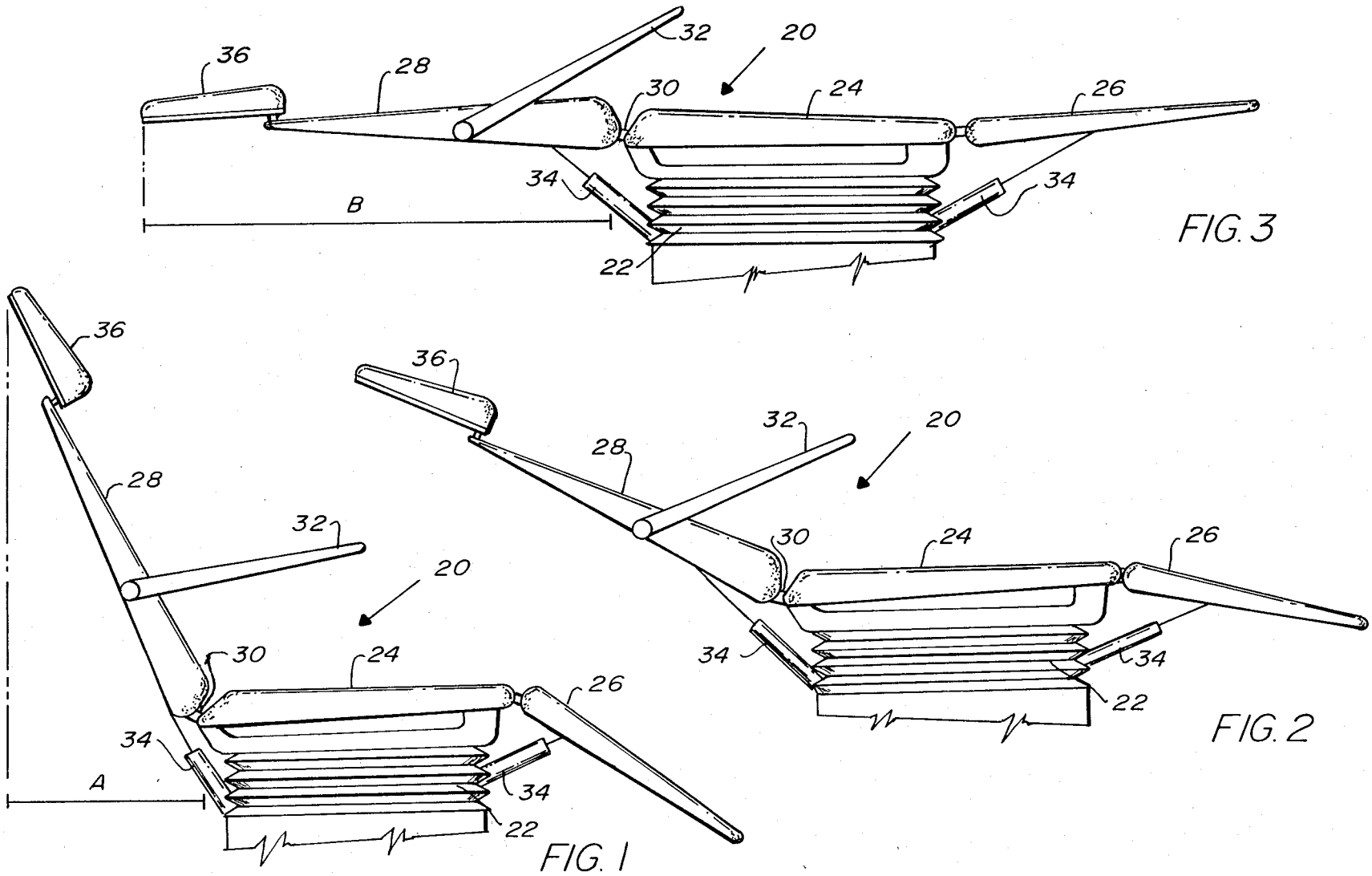
FIG. 1 is a side elevational view of a conventional patient support without the linkage of the present invention, shown in a "sit-up" position.
FIG. 2 is a view of the same, shown in an intermediate reclining position.
FIG. 3 is a view of the same, shown in a fully reclined position.

Patient Supports Prior to the Invention (FIGS. 1, 2 and 3)

In the past, patient supports have required substantial open space behind them to accommodate reclining of their backrests. As illustrated in FIGS. 1, 2 and 3, a patient support 20 in the prior art had a base 22 supporting a seat 24 with a legrest 26 pivotally attached to the front end of the seat 24 and a backrest 28 pivotally attached to the back of the seat at a pivot point 30. An armrest 32 is pivotally attached between the backrest 28 and the seat 24.

The chair 20 is shown in a fully upright position in FIG. 1. After a patient has sat in the chair, motors (not shown) are activated to lift the legrest 26, to recline the backrest 28, and to raise the seat 24, for example through hydraullic cylinders 34.

As illustrated in FIGS. 2 and 3, as the backrest 28 is lowered toward its fully reclined position, (FIG. 3), its top, on which is mounted a headrest 36, travels in a circular arc about the pivot point 30 at the connection between the backrest 28 and the seat 24.

Line A in FIG. 1 represents the horizontal distance behind the pivot point 30 by which the top of the headrest 36 extends in the fully upright position. Line B in FIG. 3 represents the horizontal distance behind the pivot point 30 by which the top of the headrest 36 extends in the fully reclined position. The ratio (B/A) of backrest extension between the fully reclined and fully upright positions in this prior patient support 20 is approximately 2.75 to 1. In other words, almost three times as much space is required behind the chair 20 when it is in the fully reclined position as compared to the fully upright position.

Figures 4, 5, 6:
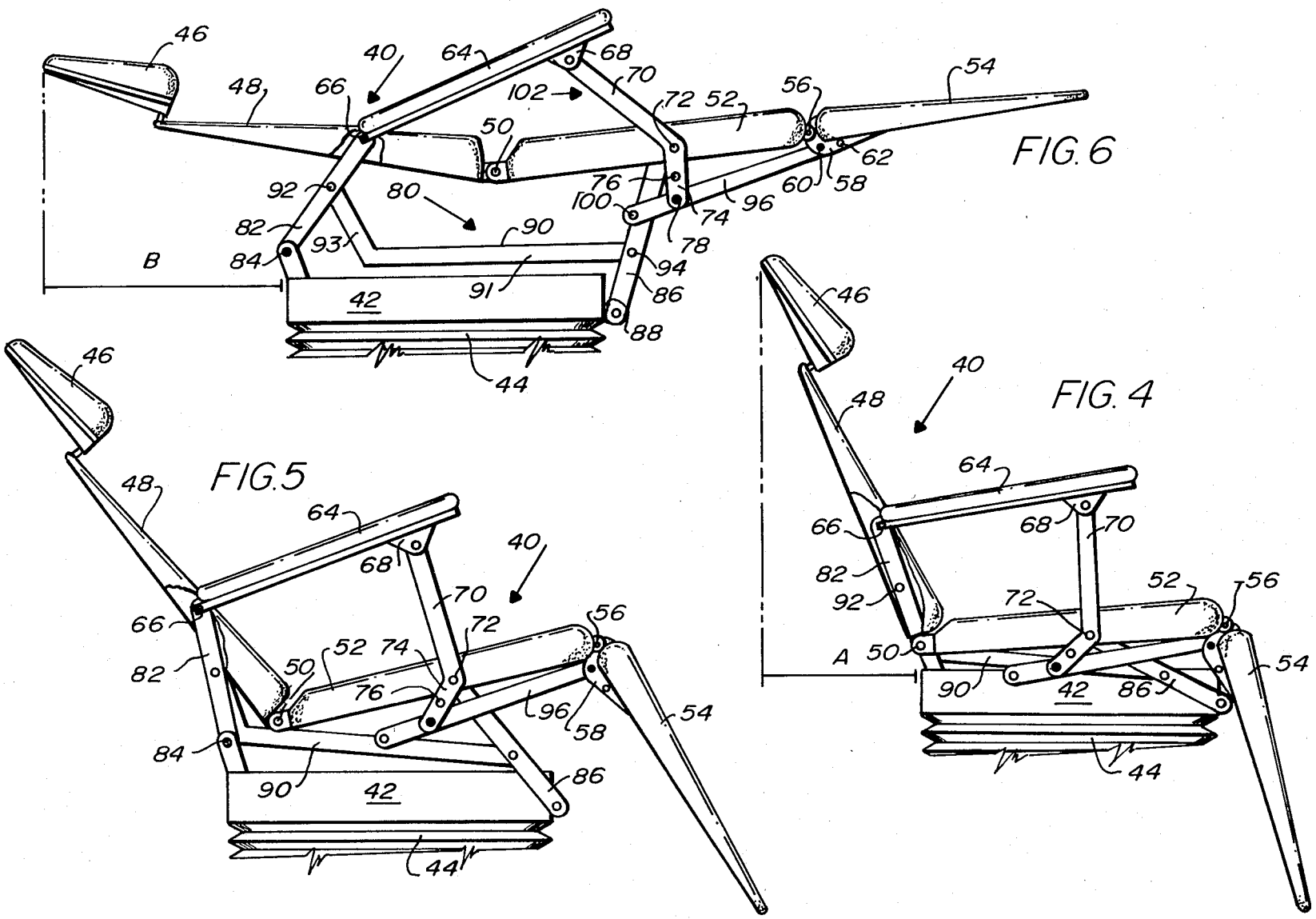
FIG. 4 is a side elevational view of a sit-up type patient support of the present invention, shown in the "sit-up" position; a part of the backrest is broken away to illustrate the top connection of the rear link.
FIG. 5 is a view of the same, shown in a partially reclined position.
FIG. 6 is a view of the same, shown in a fully reclined position.

The Sit-Up Embodiment (FIGS. 4, 5 and 6)

It will be understood, that the linkages hereinafter to be described usually constitute a pair, with one element being located at each side of the chair. Kinematically, the assembly of linkages and chair components constitute but a single mechanism. Since the linkages are mirror images at each side of the chair, only one link of each such pair will be described.

A sit-up type patient support 40 is shown in FIGS. 4–6 and has a base 42 supported atop a foldable lifting device 44 (shown broken away at the bottom), which does not form a part of the present invention and may be constructed, for example, as shown in U.S. Pat. Nos. 3,222,032 or 3,472,488. The patient support 40 has a headrest 46 (such as the headrest shown in U.S. Pat. No. 3,412,538) connected to the top of a backrest 48 which is pivotally connected at a point 50 to the back end of a seat 52. The seat 52 preferably slopes downwards from front to back at about a 5 degree angle when the patient support is in the fully upright position, as shown in FIG. 4. A legrest 54 is pivotally connected to the front of the seat 52 at a point 56 via attachment member 58. An opening 60 is disposed through the attachement member 58 near its middle, and another opening 62 is disposed through attachment member 58 toward its front. The back of an armrest 64 is pivotally attached to a side of the backrest 48 at a point 66, preferably about eight inches above the pivotal connecting point 50. A pivotal connecting member 68 depends from the bottom of armrest 64 near its front, preferably about thirteen and one-quarter inches forward of the connecting point 66, for connection to an armrest link 70. The armrest link, preferably about eight inches long, is pivotally connected at its bottom to the side of the seat 52 near its midsection at a point 72, preferably about eleven inches forward of the pivotal connecting point 50. Depending from the bottom of the armrest link 70 is an angled extension 74, preferably about three inches long. A first opening 76 is disposed through the extension 74 at about its midsection and another opening 78 is disposed through it near its bottom.

A four-bar, transverse motion linkage 80 (best illustrated in FIGS. 6, 9 and 12) includes: a rear vertical link 82, preferably about eight inches long, pivotally connected between the armrest attachment point 66 and a pivotal connecting member 84 extending slightly upwardly from the back of the base 42; a front vertical link 86, preferably about eleven inches long, pivotally connected at its top to the underside of the seat 52 near the pivotal connecting point 72 for the armrest link 70 and at its bottom, pivotally connected to a pivotal connecting member 88 extending forwardly from the front of the base 42; a horizontal link 90 pivotally connected to the rear vertical link 82 at a point 92 near its midsection and at the front to the forward vertical link 86 at a point 94 near its midsection; and the base 42 itself, which forms a fourth member of the four-bar linkage 80. The front connecting member 88 is preferably disposed about twenty and one-quarter inches horizontally forward, and about four inches vertically downward of the rear connecting member 84. The horizontal link 90 has a first portion 91 that is preferably about sixteen and seven-eighths inches long, and an angled second portion 93 that is preferably about four and one-half inches long.

Figure 8:
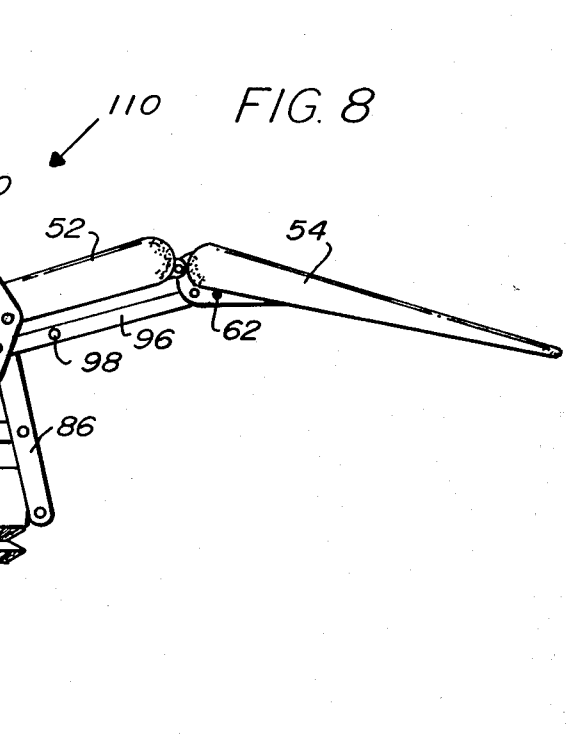
FIG. 8 is a view of the same, shown in a partially reclined position.

A leg extension link 96 is pivotally connected at its forward end through opening 60 in attachment member 58, to the legrest 54. The extension link 96 is pivotally connected through an opening 98 (opening 98 is best shown in FIG. 8), disposed somewhat forward of its rear end, to the bottom opening 78 in angled extension 74. Another opening 100 is disposed through extension link 96 at its rear.

The links 82, 86, and 90 of said four-bar linkage 80 may be constructed as solid, rectangular members having pivotal connecting members at all four corners, or may be constructed as pairs of parallel bar-type links, one member of each pair disposed on each side of the seat.

The armrest 64, the armrest link 70 and the leg extension link 96 may be constructed as single bar-type links on only one side of the seat, or may be used in parallel.

Figure 12:
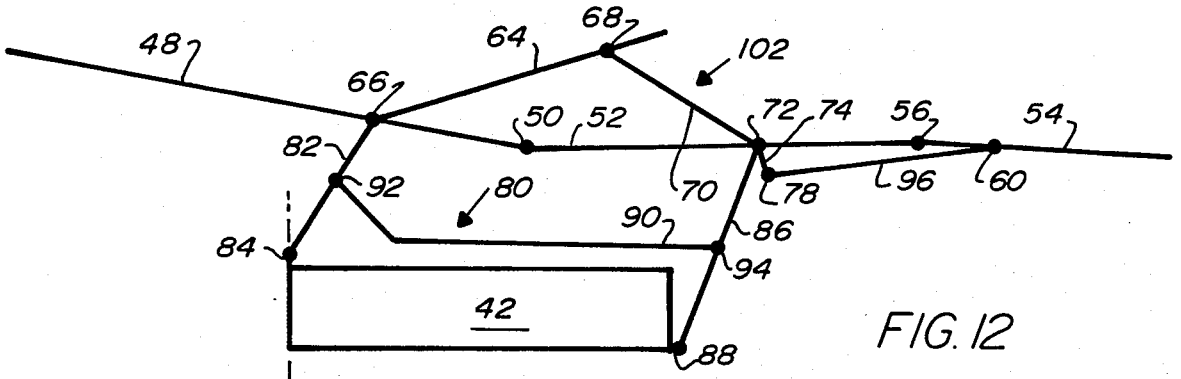
FIG. 12 is a view of the same, shown in a fully reclined position.
Figure 11:
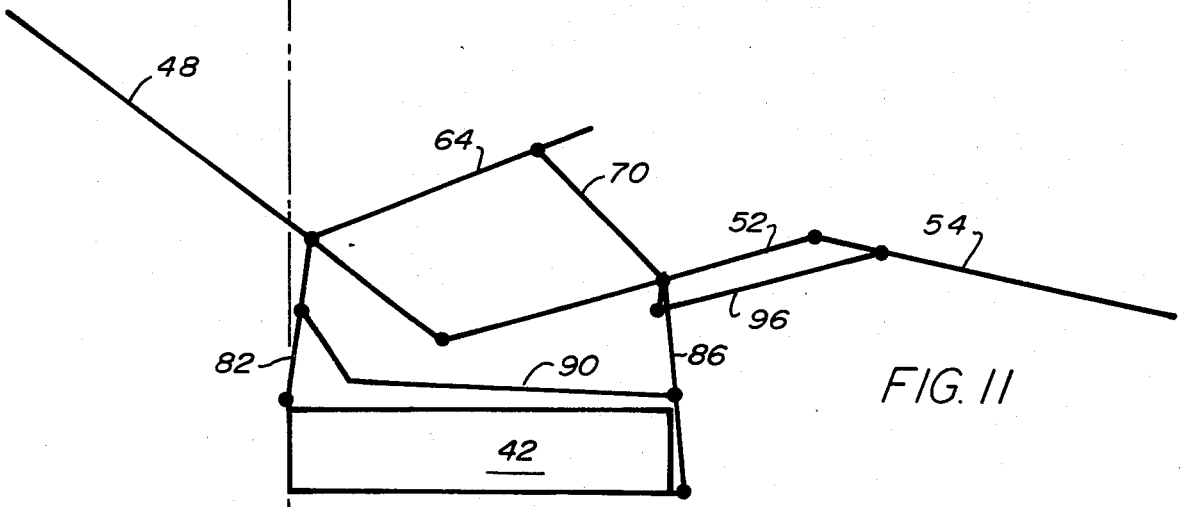
FIG. 11 is a view of the same, shown in a partially reclined position.
Figure 10:
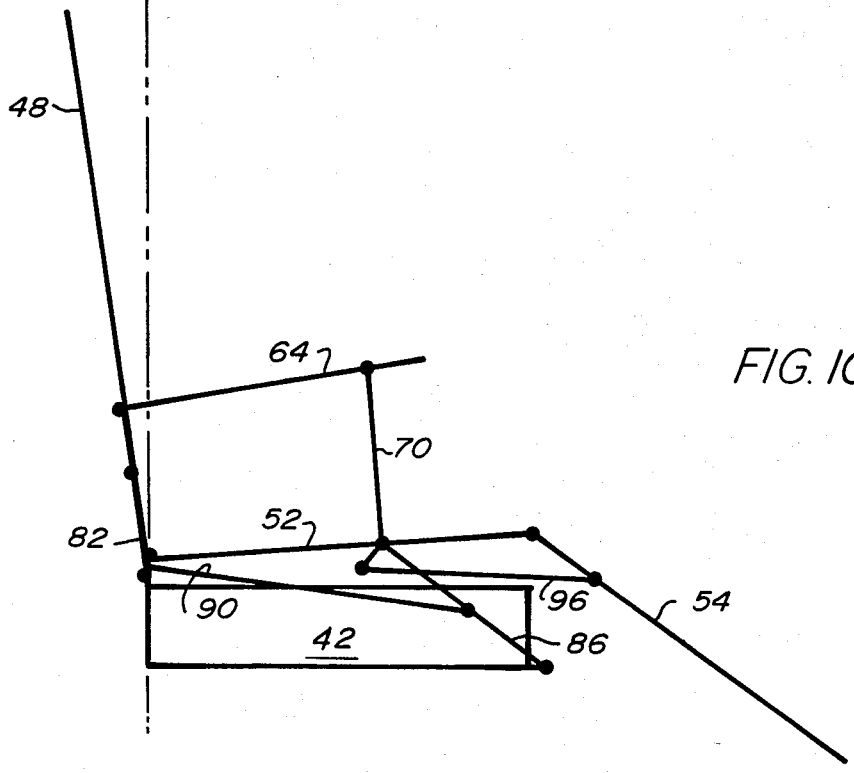
FIG. 10 is a diagramatic, side view representation of the transverse motion reclining linkage of the present invention, shown in a "sit-up" position.

In operation, as illustrated in FIGS. 4, 5 and 6, and in FIGS. 10, 11 and 12, the linkage system of the present invention causes two simultaneous movements. A first movement takes place through the four-bar linkage 80 whereby the entire patient support moves transversely forward, carried on the two vertical links 82 and 86, through the constant spacing of the horizontal link 90.

Thus, the amount of space taken up behind the patient support due to lowering of the backrest 48 is significantly reduced. A second movement takes place through a three-bar linkage 102, constituting the armrest 64, the armrest link 70, the angled extension 74, the leg extension link 96, and the attachment member 58, whereby the backrest 48 reclines as the legrest 54 lifts, and vice versa. The four-bar linkage 80 and the three-bar linkage 102 are interconnected through the backrest 48, the seat 52 and the legrest 54. The difference in length between the rear vertical link 82 and the front vertical link 86, combined with the horizontal and vertical placement of their respective pivotal connecting members 84 and 88, causes the seat 52 to move a greater horizontal distance, and along a different arc, than does the backrest 48 when the support 40 is adjusted. The increasing horizontal distance between the pivotal connecting points 66 and 72, resulting from such movement, thereby imparts motion to the three-bar linkage 102, to move the legrest 54. This simultaneous motion provides a comfortable feeling of support and equilibrium to a patient, since the patient's head does not change height with respect to the floor as much as it did during reclining in previous patient supports.

A power source (not shown), such as a motor and jack or an hydraulic pump and cylinder, is connected from a central point on the base 42 to the front vertical link 86 at a point near pivotal connecting point 94. The power source moves the four-bar linkage 80 forward or rearward, thereby facilitating the simultaneous horizontal and vertical movements of the patient support 40 of the invention.

Line A in FIG. 4 illustrates the horizontal distance between the pivotal connecting member 84 and the top of the headrest 46 when the patient support 40 is in its fully upright position. Line B in FIG. 6 illustrates the horizontal distance between the pivotal connecting member 84 and the top of the headrest 46 when the patient support 40 is in its fully reclined positon. The ratio of line B to line A (B/A) is approximately 1.5 to 1. In other words, the patient support of the present invention requires about one and one-half times the amount of space behind the base 42 for the backrest 48 when it is in the fully reclined position as compared to the fully upright position, representing a significant savings of space over that which was available before the present invention.

Figure 9:
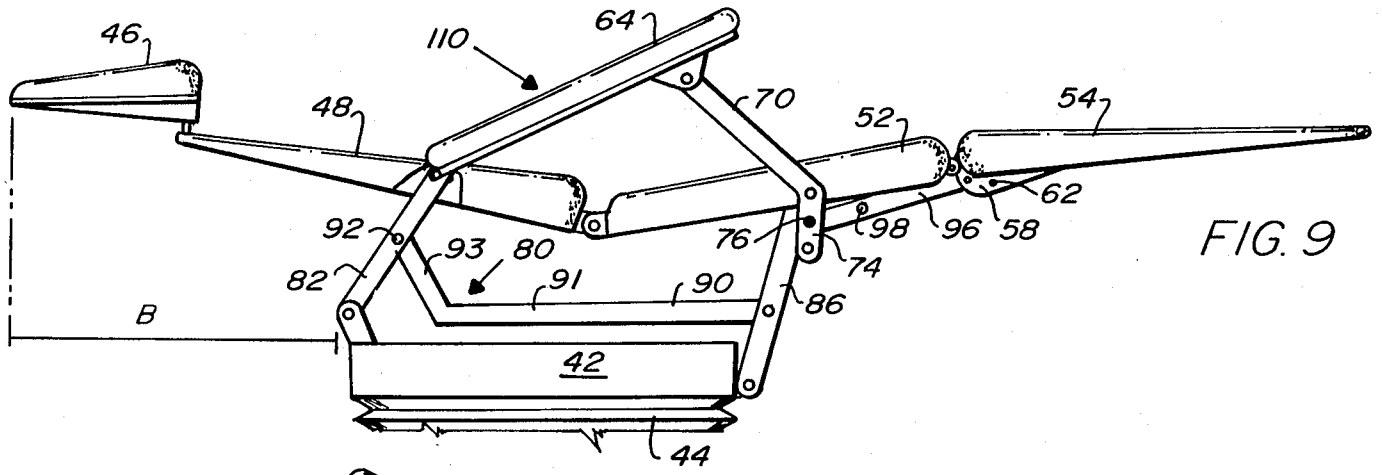
FIG. 9 is a view of the same, shown in a fully reclined position.
Figure 7:
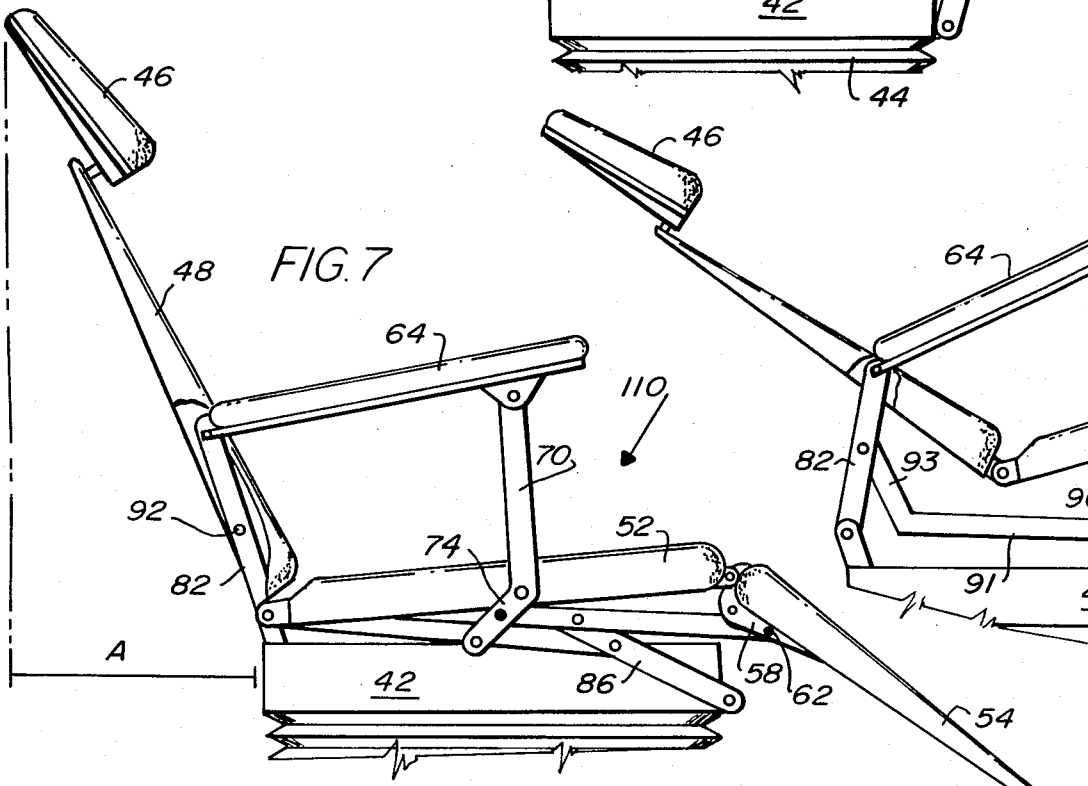
FIG. 7 is a side elevational view of a "lounge type" patient support of the present invention, shown in a "sit-up" position; a part of the backrest is broken away to illustrate the top connection of the rear link.

The Lounge Type Patient Support (FIGS. 7, 8 and 9)

A lounge type embodiment 110 of the patient support of the present invention is illustrated in FIGS. 7–9. In this embodiment, the patient's legs are already slightly elevated upon initial entry to the patient support. This position is preferred by some dentists. The linkage system of the present invention accommodates this other embodiment merely by changing the pivotal connecting points at both ends of the leg extension link 96, without detracting from the comfort of the support. The rearmost opening 100 (opening 100 is best shown in FIG. 6) in leg extension link 96 is pivotally connected to the middle opening 76 in the angled extension 74 of the armrest link 70, as illustrated in FIG. 8. The front of leg extension link 96 is pivotally connected to the forwardmost opening 62 in the legrest attachment member 58.

Operation of the lounge type embodiment 110 is identical to the sit-up type embodiment 40, and the same desirable ratio (B/A) of approximately 1.5 to 1 is obtained with it.

The preferred embodiment described herein, including the dimensions for links given, which could be proportionally varied in length and still achieve the same results, is intended to be purely illustrative, and not limiting of the scope of the invention. Other embodiments, dimensions and variations will be apparent to those skilled in the art and may be made without departing from the essence and scope of the invention as defined in the following claims.

What is claimed is:

1. A transverse motion linkage for a patient support having a base, a seat, a backrest pivotally connected to one end of said seat and a legrest pivotally connected to the other end of said seat, comprising:

a four-bar linkage having said base as its bottom link, a rear link pivotally connected between said bottom link and the backrest, a front link pivotally connected between said bottom link and the seat, and a horizontal link pivotally connected between said rear link and said front link, and a three-bar linkage having a first link, a second link and a third link, said first link pivotally connected at one end to said legrest and at the other end to said second link, said second link pivotally connected at its end remote from said first link to said third link and pivotally secured at an intermediate portion to said seat, said third link pivotally connected at its end remote from said second link to said backrest at substantially the level of its connection to said rear link of said four-bar linkage, whereby moving said patient support transversely forward on said four bar linkage reclines said backrest and raises said legrest so that the ratio of the horizontal distance between said backrest and the back end of said base in the fully reclined position, compared to said horizontal distance in the fully upright position, is about 1.5 to 1.

2. The transverse motion linkage of claim 1 wherein each of said links in said four-bar linkage comprises a pair of parallel links, one link of each said pair disposed on one side of said seat and the other link of each said pair disposed on the other side of said seat.

3. The transverse motion linkage of claims 1 or 2 wherein each of said links in said three-bar linkage comprises a pair of parallel links, one link of each said pair disposed on one side of said seat and the other link of each said pair disposed on the other side of said seat.

4. The transverse motion linkage of claim 1 wherein said rear link is shorter than said front link.

5. The transverse motion linkage of claim 1 wherein said rear link is about eight inches long, and said front link is about eleven inches long, said front link being pivotally attached to said base about twenty-one and one-quarter inches forward and about four inches below the pivotal attachment point of said rear link to said base.

6. A patient support for conserving space in an operatory, comprising:

a base, having a front end and a back end;

a seat member supported on said base, said seat member having two sides, a front, a back, a top and a bottom, a leg support member having a top pivotally connected to the front of said seat member, a back support member having a bottom pivotally connected to the back of said seat member, a pair of arm supports, each arm support having a substantially horizontal member pivotally connected at a back end to an intermediate portion of said back support member, and having a substantially vertical member pivotally connected at a top end to said horizontal member, and pivotally connected near a bottom end to a side of said seat member, the bottom end of each said vertical member extending below said seat member, rear support linkage means having a top and a bottom, said rear support linkage means pivotally connected at its top to said back support member substantially at the pivotal connection axis of said horizontal member of said arm supports, and pivotally connected at its bottom to said base near its back end, front support linkage means having a top and a bottom, said front support linkage means pivotally connected at its top to said seat member substantially at the pivotal connection axis of said vertical members of said arm supports, and pivotally connected at its bottom to said base near its front end, horizontal linkage means having a front end and a rear end, said front end pivotally connected to said front support linkage means between its top and its bottom, and said rear end pivotally connected to said rear support linkage means between its top and its bottom, leg support linkage means having a front end and a back end, said leg support linkage means pivotally connected at its front end to an intermediate portion of said leg support member, and pivotally connected at its back end to the bottom end of at least one of said vertical members of said arm supports, and power means having connecting means between said base and said front support linkage means, for moving said patient support forward, whereby said forward movement simultaneously lowers said back support member and raises said leg support member.

7. The patient support of claim 1 wherein said seat member is tilted downwardly from front to back at an angle of about 5 degrees when said patient support is in a fully upright position.

8. The patient support of claim 1 wherein the ratio of the horizontal distance between the top end of said back support member and the back end of said base in the fully reclined position, compared to said horizontal distance in the fully upright position, is about 1.5 to 1.

9. The patient support of claims 1 or 8 wherein said rear support linkage means is shorter than said front support linkage means.

10. The patient support of claim 9 wherein said rear support linkage means is about eight inches long, and said front support linkage means is about eleven inches long, said front support linkage means each being pivotally attached to said base about twenty-one and one-quarter inches forward and about four inches below the pivotal attachment point of said rear support linkage means to said base.

11. The patient support of claim 10 wherein said rear support linkage means, said front support linkage means, said horizontal linkage means, and said leg support linkage means each comprises a pair of parallel, bar-type link members, one member of each said pair disposed on either side of said patient support.

12. A transverse motion linkage for a patient support having a base, a seat, a pivotable backrest and a pivotable legrest, comprising:

a first, vertical link pivotally connected between a front portion of said base and a front portion of said seat, a second, vertical link pivotally connected between a back portion of said base and a mid-portion of said backrest, a third, horizontal link, pivotally connected between said first and said second links at a point near each of their midsections, a fourth, horizontal link pivotally connected to a side of said backrest at a point near the point of connection to said second, vertical link, a fifth, vertical link, pivotally connected at one end to said fourth, horizontal link near its end opposite said backrest, and pivotally connected to a side of said seat at a point near the point of connection to said first, vertical link, said fifth link having a free bottom end extending below its point of pivotal connection to said seat, and a sixth link, pivotally connected at one end to said free bottom end of said fifth link, and pivotally connected at the other end to said leg rest, whereby forward transverse movement of said patient support on said first and second links simultaneously causes downward pivotal movement of said backrest and upward pivotal movement of said legrest.

13. The transverse motion linkage of claim 12 wherein said first, second, and third link each comprise a solid member with extensions at all four corners for pivotal connection.

14. The transverse motion linkage of claim 12 wherein each of said links comprise a pair of parallel, bar-type link members, one member of each said pair disposed on either side of said patient support.

15. The transverse motion linkage of claim 12 wherein the ratio of the horizontal distance between said backrest and the back end of said base in the fully reclined position, compared to said horizontal distance in the fully upright position, is about 1.5 to 1.

16. The patient support of claims 12 or 15 wherein said second link is shorter than said first link.

17. The patient support of claim 16 wherein said second link is about eight inches long, and said first link is about eleven inches long, said first link being pivotally attached to said base about twenty-one and one-quarter inches forward and about four inches below the pivotal attachment point of said second link to said base.

* * * * *